US005207449A

United States Patent [19]

Horn

[11] Patent Number: 5,207,449

[45] Date of Patent: May 4, 1993

[54] SKI SAFETY BINDING

[75] Inventor: Hans Horn, Bern, Switzerland

[73] Assignee: Skis Rossignol S.A., Voiron, France

[21] Appl. No.: 808,943

[22] Filed: Dec. 13, 1991

Related U.S. Application Data

[63] Continuation of Ser. No. 479,363, Feb. 13, 1990, abandoned.

[30] Foreign Application Priority Data

Feb. 27, 1989 [FR] France ..... 89 02518

[51] Int. Cl.[5] ..... A63C 9/084

[52] U.S. Cl. ..... 280/628; 280/634; 280/623

[58] Field of Search ..... 280/623, 626, 628, 630, 280/633, 634

[56] References Cited

U.S. PATENT DOCUMENTS

| | | | |
|---|---|---|---|
| 4,095,821 | 6/1978 | Salomon | 280/628 |
| 4,577,887 | 3/1946 | Bardin et al. | 280/628 |
| 4,681,338 | 7/1987 | Spitaler | 280/628 |
| 4,900,053 | 2/1990 | Freisinger et al. | 280/628 |

FOREIGN PATENT DOCUMENTS

| | | |
|---|---|---|
| 0202440 | 4/1989 | European Pat. Off. . |
| 2628647 | 9/1989 | France . |

*Primary Examiner*—Richard M. Camby

*Attorney, Agent, or Firm*—Kane, Dalsimer, Sullivan, Kurucz, Levy, Eisele and Richard

[57] ABSTRACT

Binding intended for binding the front of the boot or the heel, comprising a body (13) which pivots (14) or is stationary and provided with a grip (15) articulated on the body about a horizontal pin (16). The body and the grip are held in the closed position by at least one spring (18) acting via a piston (17) on a transmission device comprising two moving parts articulated on each other (21, 24). One of these moving parts (21) bears permanently against the grip and the other moving part (24) bears permanently against lateral-retention means which consist, for example, of two stationary stops (10) against which bear levers (33*a*) acting on a transmission element (26). A lateral displacement of the body, or of the boot respectively, in particular causes the vertical pressure of the grip on the boot to be reduced.

9 Claims, 7 Drawing Sheets

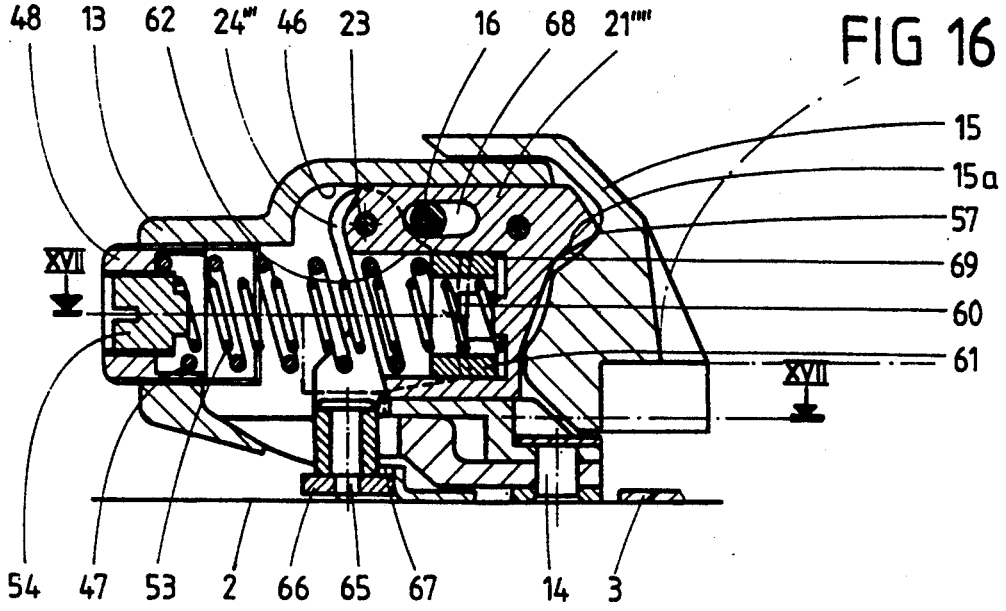
FIG 16
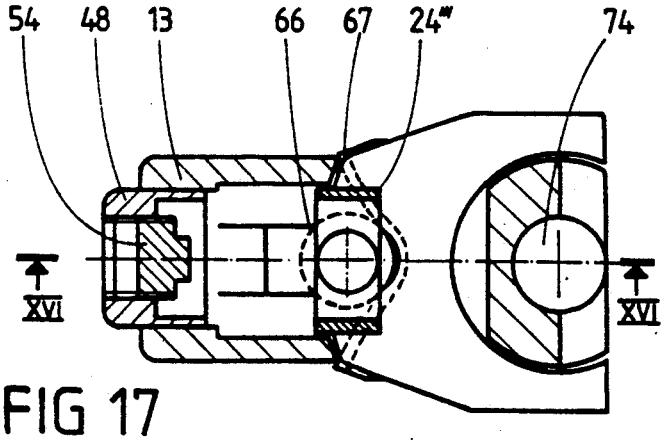
FIG 17
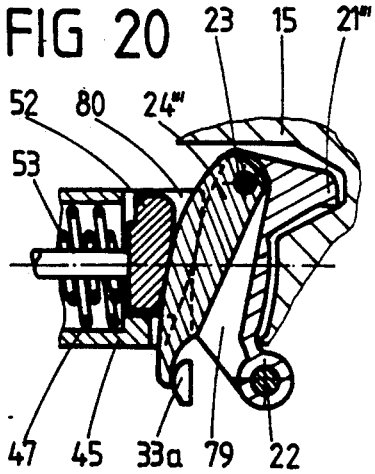
FIG 20
FIG 18
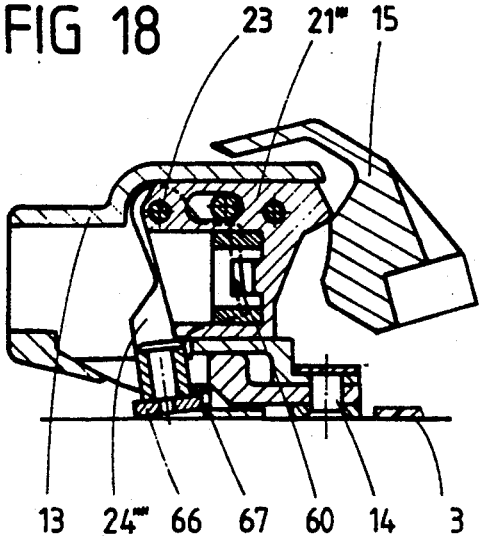
FIG 19
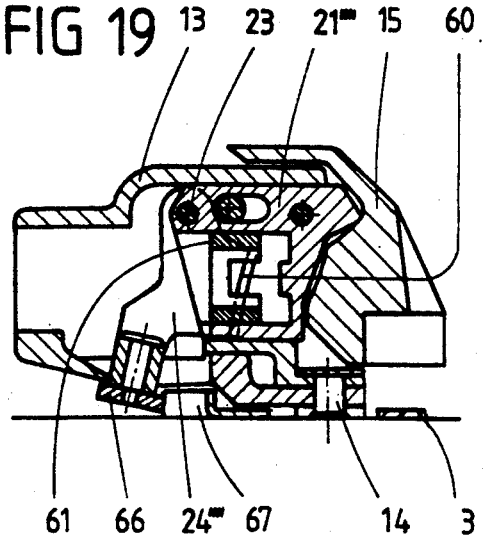

SKI SAFETY BINDING

This is a continuation of application Ser. No. 479,363, filed on Feb. 13, 1990, now abandoned.

FIELD OF THE INVENTION

The present invention relates to a ski safety binding intended to hold in place the heel or the end of the foot, comprising a body, a grip articulated on this body about a horizontal pin, lateral-retention means for the boot, elastic means, which work together at least partly, for returning the lateral-retention means and the grip into the closed position of the binding, these return means comprising at least one spring acting via at least one piston on a transmission mechanism, capable of rotational or translational movement and set between, on the one hand, the piston and, on the other hand, the grip and the lateral-retention means.

PRIOR ART

In known ski bindings, which consist of a front toe unit and a heel unit, the body is either fixed or pivots about a vertical pin. Front toe units are known in which the body is fixed and the grip not articulated and in which the boot is retained laterally by two levers articulated about two vertical pins. Furthermore, front toe units are known with a pivoting body and a non-articulated grip. In both cases the height of the grip can be adjusted but a satisfactory adjustment is difficult to achieve. Either play remains or the boot is jammed, it being possible in addition for a jamming to be caused by the presence of dirt or ice. Now in the event of a fall accompanied by a twisting, the foot must be able to slide laterally in order to move one of the levers, or the body respectively, in rotation and to release the binding. Jamming or very high frictional forces affect the behavior of the binding to the extent of preventing its release. As for the front toe units and the heel units from which the grip lifts off in the event of a forward fall, the vertical pressure on the heel or the end of the foot remains generally constant during a rotational displacement of the body of the binding, which often makes it difficult for the foot to be freed laterally because of the substantial frictional forces between the sole of the boot and the ski. These frictional forces vary furthermore from one sole to the other and depending on the condition of the sole and of the bearing surface of the sole on the ski. Adjustment, of the binding for its release under torsion becomes consequently very difficult or even impossible.

A binding with a pivoting body is, moreover, known from the document DE-A-2,812,149 in which the pressure on the heel disappears completely when the body is moved in rotation. This binding comprises a fixed toe unit consisting of a vertical flat surface of the pivot against which a lever, in the form of a rocker articulated at the end of the piston, is held in a bearing manner. The articulated grip bears against the upper part of this lever with a transverse bar which is displaced in a slot of the body. According to an alternative embodiment described in this document, a lever is articulated at its lower end between the piston and the spring, the plane end of the piston bearing against the flat surface of the toe unit. In this case as well, the articulated grip bears against the upper end of the lever with a transverse bar. In both cases, as soon as the body of the binding is moved in rotation following a twisting of the leg, play appears between the transverse bar of the grip and the lever such that the foot begins to fit loosely in the binding, it being possible for such a loose fit to give rise to a feeling of unsafeness, especially if it affects the heel, and reactions capable of causing a fall, whereas twisting alone would not have caused the fall.

The object of the present invention is to ensure an interdependence of the forces and the reactions exerted vertically and laterally by the binding on the boot, and in particular a reduction of the vertical pressure of the grip on the boot when subjected to torsional stress.

SUMMARY OF THE INVENTION

To this end, in the binding according to the invention, the said transmission mechanism comprises two moving parts articulated on each other about an axis parallel to the axis of the articulation of the grip on the body, one of these moving parts bearing permanently against the grip and the other moving part bearing directly or indirectly against the lateral-retention means, the piston, or the pistons respectively, bearing against one of the moving parts at a point situated between its articulation on the other moving part and its part bearing against the grip, or against the lateral-retention means respectively.

It emerges from the construction thus defined that the force with which the piston bears against the moving part in question is at all times balanced by two opposite forces acting at two points situated above and below the bearing point of the piston respectively. Upon the exertion of a high torsional stress, one of these forces increases and pushes the piston back, causing the moving part bearing against the piston to pivot on the other moving part. Because of this pivoting, the distance increases between the bearing point of the piston on the moving part and the point of application of the other force. The moment being virtually unaltered and the system being at all times in equilibrium, this force decreases, which corresponds to a decrease in the reaction of the grip, in other words in the pressure of the grip on the boot.

So as to obtain a progressive decrease in the pressure of the grip, the moving part bearing against the piston preferably has a cylindrical convex surface with a generatrix parallel to the axis of articulation of the moving parts and in contact with the piston which has a plane face.

Conversely, the piston may have a cylindrical surface with a generatrix parallel to the axis of articulation of the moving parts and bearing against a plane face of the moving part in question.

The cylindrical surfaces are not necessarily circular cylindrical surfaces.

The moving parts are preferably permanently in linear contact with the piston, the grip and the respectively such that the wear on the parts in contact is negligible and does not affect the satisfactory operation of the binding.

BRIEF DESCRIPTION OF THE DRAWINGS

The attached drawing shows, by way of example, seven embodiments of the invention.

FIG. 16 is a view in vertical axial cross-section of a front toe unit according to a sixth embodiment.

FIG. 17 is a view in cross-section along XVII—XVII in FIG. 16.

FIG. 18 shows in part the binding corresponding to FIGS. 16 and 17 during release in a forward fall.

FIG. 19 shows in part the same binding during release under torsion.

FIG. 20 shows in part a seventh embodiment, derived from the third embodiment, during release under torsion.

DESCRIPTION OF THE PREFERRED EMBODIMENTS

Figure 1A:
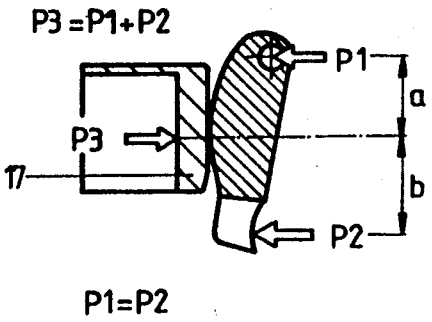
FIG. 1*a* is a view of the forces on lever 24 of FIG. 1.
Figure 1:
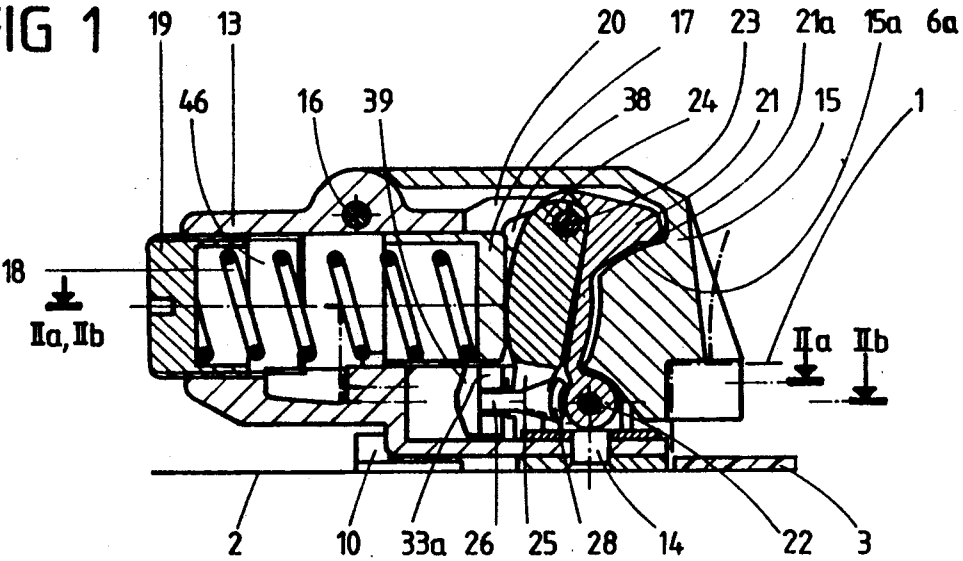
FIG. 1 is a view in axial vertical cross-section along I—I in FIG. 2 of a front toe unit according to a first embodiment.
Figure 2:
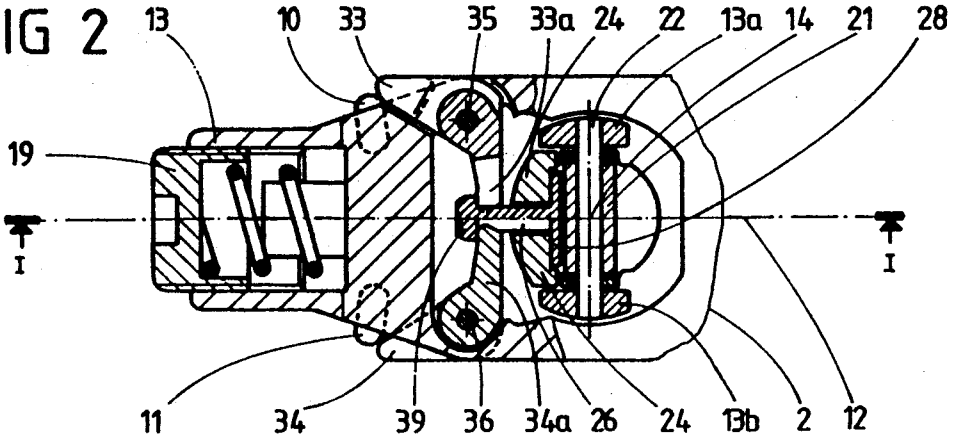
FIG. 2 is a view in cross-section along IIa—IIa and II—IIb in FIG. 1.

The front toe unit shown in FIGS. 1 and 2 comprises a body 13 mounted pivotably on a ski 2 by means of a pivot 14. A grip 15 is articulated on the body 13 about a pin 16. The position of the grip 15 shown in FIG. 1 is the position in which it has just pressed the front of a boot 1 against a plate 3 made from a material with a small coefficient of friction. The body 13 has a horizontal bore 46 in which slides a piston 17 pushed forwards by a spring 18 working in compression and the compression of which may be adjusted by means of a threaded cap 19 screwed into the bore 46. The front part of the body 13 has a vertical gap 20 limited by two cheeks 13a and 13b of the body 13 (FIG. 2) and in which is mounted a first lever 21 which extends approximately vertically and is articulated at its lower end about a pin 22 on the body 13. This first lever 21 is provided with a nose 21a which ends in a rounded rectilinear ridge bearing linearly against an incline 15a of the grip 15 under the pressure of the spring 18. A second lever 24, which extends downwards and is applied against the first lever 21 by the piston 17, is articulated about a pin 23 on the lever 21 near its upper end. The lever 24 bears against the piston 17 with a cylindrical curved surface with generatrices parallel to the pins 22 and 23. At its lower end, the second lever 24 has a vertical central gap 25 in which is engaged a horizontal axial transmission rod 26 having at one of its ends a widened part 28 which extends between the split end of the second lever 24 and the first lever 21, and at its other end has a head 39 against the rear of which bear the ends of two levers 33 and 34 which are pivoted at a mid-point about two vertical pins 35 and 36 respectively in the body 13. These two levers 33 and 34 are identical and are mounted identically and symmetrically about the vertical plane of symmetry 12 of the binding. They appear different, however, in FIG. 2 because of the different levels of section IIa and IIb shown above and below the axis 12 in FIG. 2 respectively. The levers 33 and 34 bear against the head 39 with a split end such as 33a. The other end of the lever 33 bears against a stationary stop 10, whereas the other end of the lever 34 bears against a second stationary stop 11, the stops 10 and 11 being arranged symmetrically about the axis 12.

In the position shown in FIGS. 1 and 2, in other words the position with the boot on and without any dangerous stress, the spring 18 maintains the grip 15 in the folded-down position and it furthermore pulls the rod 26 forwards via the second lever 24. The rod 26 presses the levers 33 and 34 against their stops 10 and 11 with its bearing surface 39, which causes the binding to be maintained aligned along the axis of the ski because of the symmetry of the construction. If the binding is used as a heel unit, it will comprise in addition a lever known per se, and which is not shown, for opening and closing the grip by hand for taking off and putting on the boot respectively and the grip will be provided with a spur for it to be closed by the heel. The pin 23 traverses the cheeks 13a and 13b through two slots 28 in the arc of a circle centered on the pin 22.

The operation of the binding, both as a front toe unit and as a heel unit, will be described with reference to FIGS. 3 to 5.

Let us first examine the case of a front toe unit. If the toe unit is subjected to torsional stress, the boot tends to move the grip 15, and consequently the body 13, in rotation about the pivot 14. According to the direction of rotation, one or other of the levers 33 and 34 pivots about its axis, bearing against its stop 10, or 11 respectively, which causes the movement of the second lever 24 which pivots on the first lever 21, the latter remaining stationary. The piston 17 is pushed back by compressing the spring 18, as shown in FIG. 4. Beyond a certain angle of rotation of the body 13, the boot escapes laterally from the binding. If the torsional stress is insufficient to cause a release, the reduction in the pressure of the lever 21 on the grip 15 permits only a slight pivoting of this grip. The nose 21a is displaced very slightly on the incline 15a of the grip. Friction is reduced by reducing the vertical pressure. After release, the binding is returned to its initial position by the spring and the action of the levers and the inclines.

Figure 4:
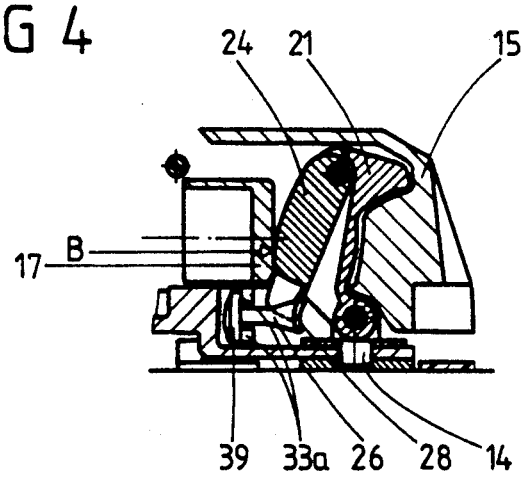
FIG. 4 shows in part the same binding during release under torsion.
Figure 5:
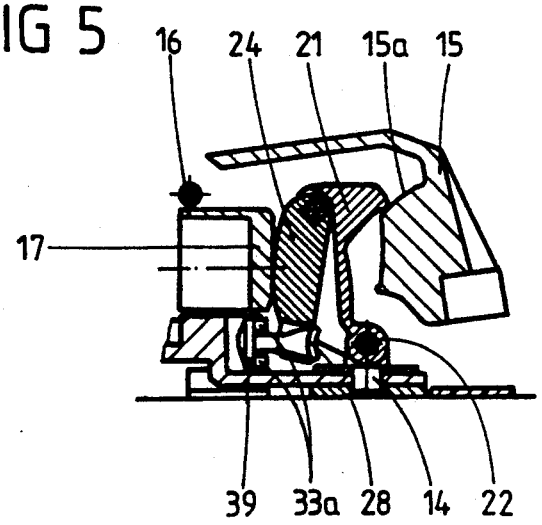
FIG. 5 shows in part the same binding stressed diagonally, in other words in a backward fall and under torsion.
Figure 6:
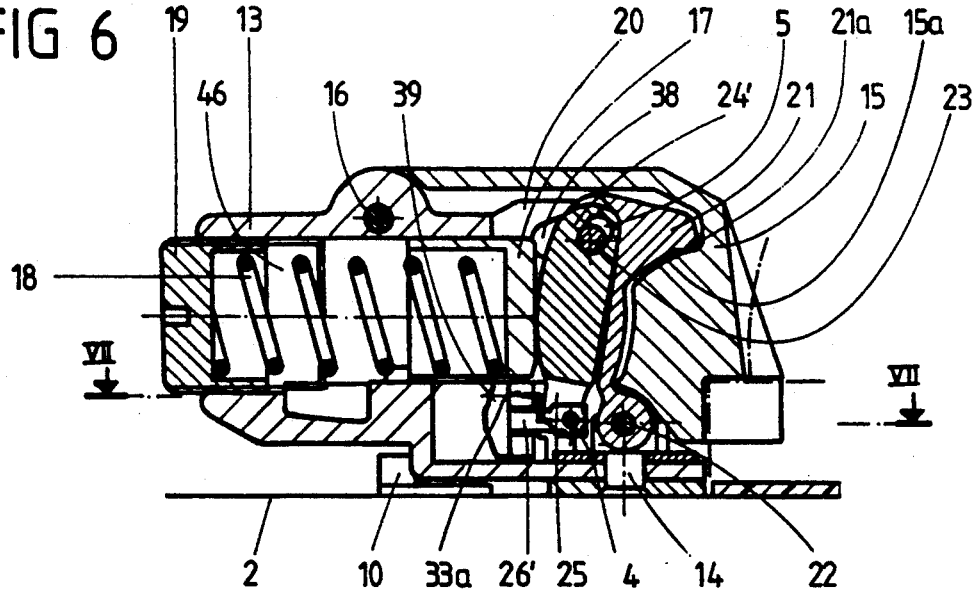
FIGS. 6 to 9 show an alternative embodiment of the first embodiment and correspond to FIGS. 1, 2, 3 and 5 respectively.
Figure 7:
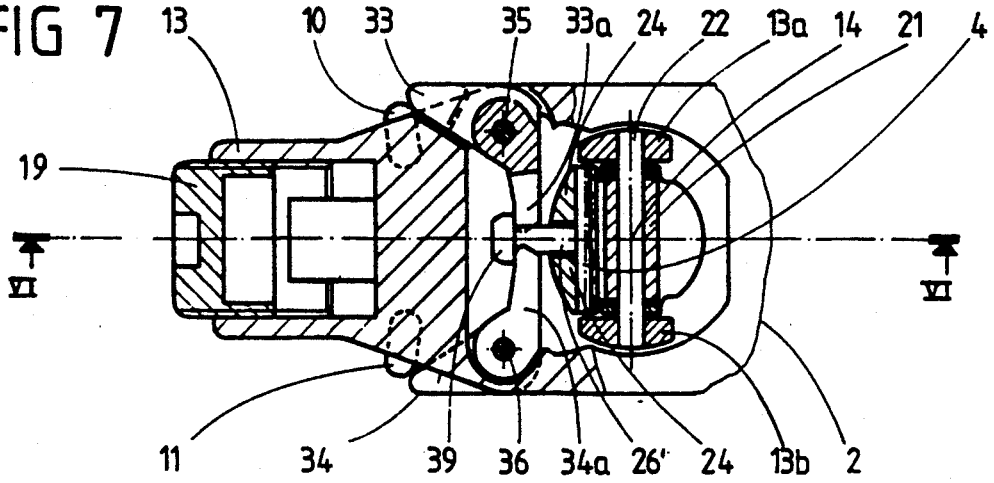

The case of a combined twisting and backward fall is shown in FIG. 5. This position results from the combination of the displacements shown in FIGS. 3 and 4.

Figure 3:
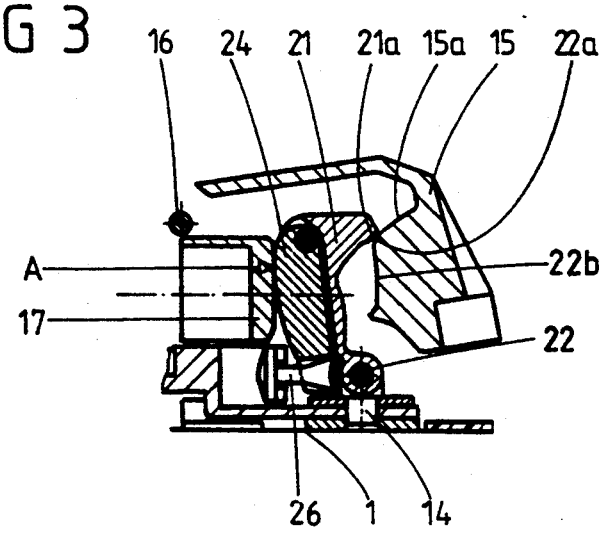
FIG. 3 shows in part the same binding during release in a backward fall.

The release of the toe unit in a backward fall is shown in FIG. 3. Under the effect of the backward fall, the grip 15 is raised by the end of the foot pushing back the nose 21a of the lever 21 which compresses the spring 18 by pushing back the piston 17. The boot is freed when the nose 21a reaches the end 22a of the incline 15a of the grip 15. This end 22a is not exceeded with the result that the grip 15 is returned into its initial position under the pressure of the spring and by the cam effect of the incline 15*a*. It will be noted that in this cas the second lever 24 does not intervene and the rod 26 remains stationary; the levers 21 and 24 behave as a single lever.

In the case where the binding is used as a heel unit, the behavior differs in only one respect: in a forward fall, the end 22*a* of the incline 15*a* is exceeded and the grip remains open after release, the nose 21*a* of the lever 21 bearing against the surface 22*b* of the grip.

These remarks may be applied to all the embodiments described.

Figure 3A:
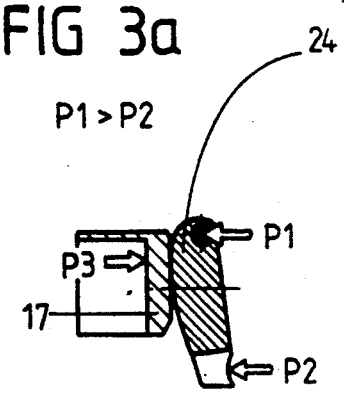
FIG. 3a is a view of the forces on lever 24 of FIG. 3.

If the bearing point, or more exactly the bearing line, of the piston 17 against the second lever 24 is examined, it will be noted that in FIG. 1 this bearing point is approximately equidistant from the pin 23, the point of action of the reaction force of the grip, and the lower end of the lever 24, the point of action of the reaction force of the stops 10 and 11. In FIG. 3, it will be noted that this point of action has moved towards the pin 23, to the point A, whereas in FIG. 4 this point of action has moved downwards, to a point B. There is therefore a variation in the lever arms of the reaction forces relative to the bearing point of the piston. This variation is particularly favorable, as will be explained using FIGS. 1*a*, 3*a* and 4*a* which diagrammatically show three states of equilibrium for three characteristic states of the binding. P1 is the force exerted by the grip 15 on the pin 23 of the lever 24. P2 is the force exerted on the end 25 of the lever 24 by the reaction of the stops 10 and 11. P3 is the force exerted by the piston 17 on the lever 24. When the system is in equilibrium, P3=P1+P2. The lever arms of the forces P1 and P2 are designated by a and b.

When the system is in equilibrium, relative to the point of application of the force P3, $$P1 \times a = P2 \times b$$

Dividing by P2×a, we obtain $$\frac{P1}{P2} = \frac{b}{a}$$

The ratio of the forces P1 and P2 is therefore equal to the inverse ratio of their lever arms. The length of these lever arms therefore plays a very important role in determining the release forces of the binding. Moreover, it emerges from FIGS. 3*a* and 4*a* that these lever arms a and b vary as a result of the convex shape of the lever 24. By means of this convex shape and the progressive characteristic of the spring, it is possible to obtain a specific behavior during diagonal release, in other words in the case of a forward fall accompanied by twisting.

Diagonal behavior is favorable if the torsional energy required for the release is less than the torsional energy required for release under torsion alone. Now if FIGS. 4 and 5 are compared, it will be noted that this is indeed the case, since the lever arm b is substantially shorter in the position corresponding to FIG. 4 than in the position corresponding to FIG. 5, from which it follows that P2 is substantially greater in the case of FIG. 4.

Conversely, it is appropriate for the energy required for the release with a forward fall, or a backward fall respectively, to decrease if the leg is simultaneously subjected to a twisting. Now this is indeed the case since the lever arm a of the force P1 is larger in the position corresponding to FIGS. 4 and 4*a* than in the position corresponding to FIGS. 3 and 3*a*, which means that, conversely, P1 is smaller during diagonal release than during release with a simple forward fall. In all cases, the diagonal release does not result from the sum of the forces required for the release with a forward and with a twisting fall respectively, but the forces required are on the contrary reduced, which concurs with the teaching relating to the resistance of the leg in the event of superposed flexural and torsional forces.

Figure 8:
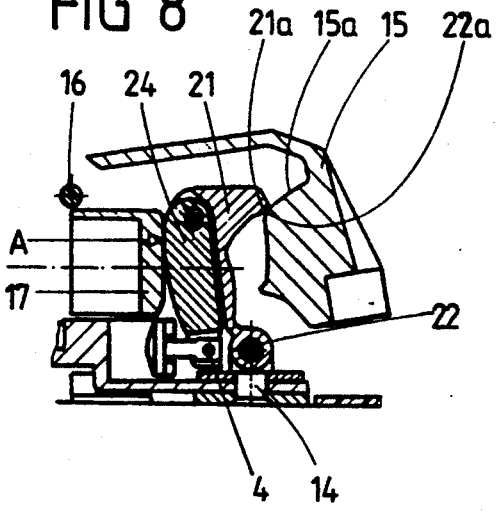
Figure 9:
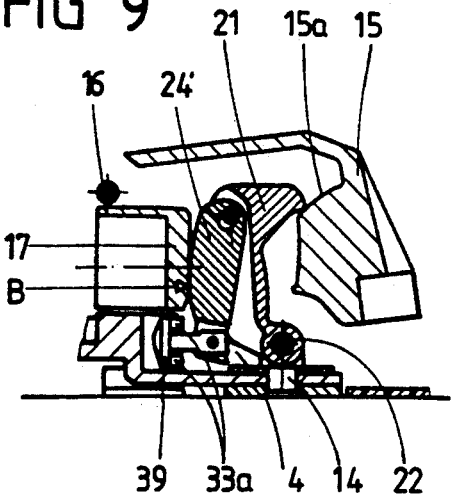
Figure 10:
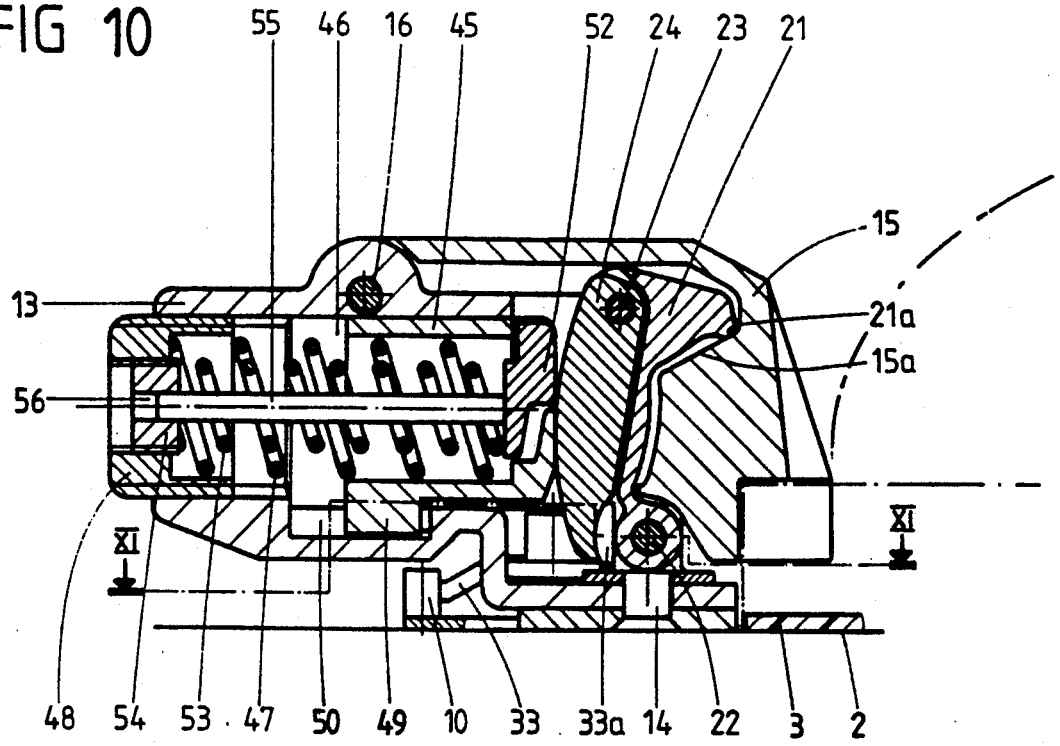
FIG. 10 is a view in vertical axial cross-section of a front toe unit according to a third embodiment.
Figure 11:
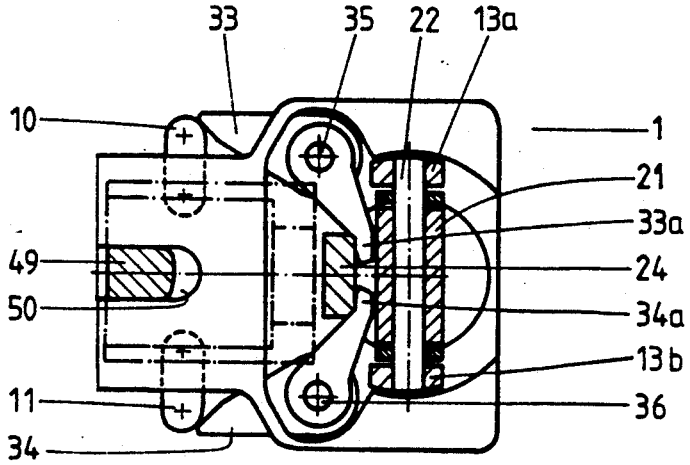
FIG. 11 is a view in cross-section along XI—XI in FIG. 10.

The lever 24 could be articulated on the rod 26. This alternative embodiment is shown in FIGS. 6 to 9. The lever 24' corresponding to the lever 24 is articulated on the rod 26, by means of a pin 4. So that this articulation 4 does not interfere with the movement of the levers 21 and 24', the lever 24' has a slot 5 for the passage of the hinge pin 23 of the two levers. FIGS. 8 and 9 illustrate the displacement of the pin 23 in the slot 5 for two characteristic positions, namely during release in a forward fall, or a combined twisting and forward fall respectively.

It will furthermore be noted that, with a relatively simple construction, it has been possible to maintain permanent linear contacts between the nose 21*a* of the lever 21 and the incline 15*a* of the grip 15, between the piston 17 and the lever 24, and between the stops 10 and 11 and the levers 33 and 34. Now such a linear contact has the advantage over the devices with point contact used up until now of much less wear and a much smaller sensitivity to dirt. The point contacts appearing up until now in bindings, whether with a ball, a spherical cap or a ridge against a cylindrical surface, give rise to the formation of a hollow caused by wear, which hollow completely alters the characteristics of the binding and may make safety impossible. The linear contacts further enable metals which are less hard, or even plastic materials, to be used.

A third embodiment of the invention will now be described with reference to FIGS. 10 to 13. So as to lighten the description and to avoid purposeless repetitions, the parts of the binding which are identical to the first embodiment or have undergone only minor modifications are designated by the same references. In this embodiment, the levers 33 and 34 bear directly against the lower end of the second lever 24 by their ends 33*a* and 34*a*. A piston 45, against which acts a first spring 47, the precompression of which may be adjusted by means of a threaded cap 48, is mounted in the bore 46. The piston 45 has, in its lower part, a rib 49 engaged in a guide groove 50 in order to maintain the piston 45 in a given angular position in its bore. The frontal face of the piston 45 bearing against the rounded face of the lever 24 is not continuous but extends only over the lower half of this frontal surface. The upper part is occupied by a second piston 52 on which acts a second helical spring 53 coaxial with the spring 47 but with a smaller diameter so as to bear only against the piston 52. The precompression of the spring 53 may be adjusted individually by means of a threaded cap 54 screwed into the threaded cap 58. The piston 52 is furthermore integral with a guide rod 55 sliding in a bore 56 provided in the threaded cap 54.

Figure 12:
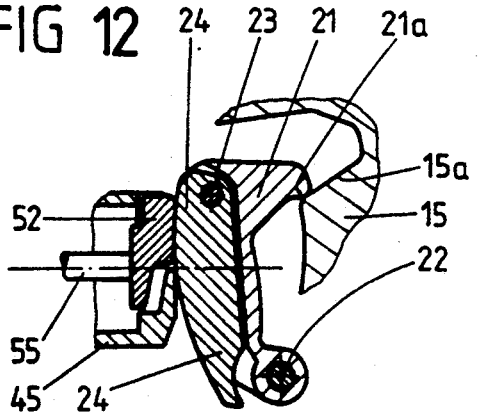
FIG. 12 shows in part the same binding during release in a backward fall.
Figure 13:
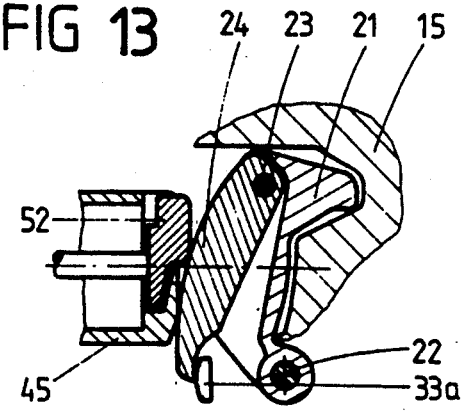
FIG. 13 shows in part the same binding during release under torsion.

Upon a forward fall (for a front toe unit) without any substantial twisting, the grip 15 pushes the first lever 21 back and with it the second lever 24 which simultaneously pushes back the pistons 45 and 52 by compressing the two springs 47 and 53 (FIG. 12). The force required is substantial and, moreover, increases rapidly with the raising of the grip 15.

On the other hand, when under torsion alone (FIG. 13), one of the levers 33 or 34, for example the lever 33, moves the lower end of the second lever 24 with its arm 33a. In its displacement, the lever 24 mainly pushes back the piston 45 and only slightly the piston 52 with the result that it is the outer spring 47 which is mainly compressed. It is therefore possible to adjust differently the elastic resistance to release with a backward and twisting fall. Furthermore, as in the first embodiment, and for the same reasons, the vertical pressure of the grip on the boot decreases when the binding is subjected to torsional stress.

Figure 14:
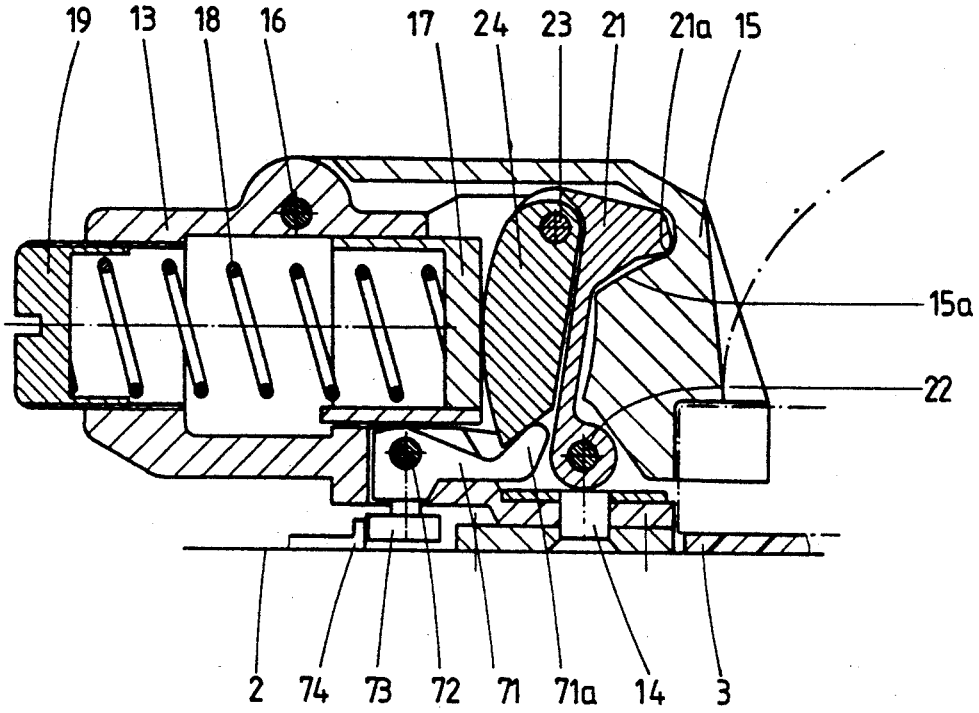
FIG. 14 is a view in vertical axial cross-section of a toe unit according.to a fourth embodiment.

A fourth embodiment is shown in FIG. 14. As in the previous cases, it may be either a front toe unit or a heel unit. The elements which are identical or similar to those in the first embodiment have again been designated by the same references. Virtually the same body 13 and the same levers 21 and 24, as well the piston 17 and a single spring 18, are to be found again in this embodiment. This fourth embodiment differs from the first embodiment by the means for returning the body 13 under torsion: the body 13 carries a lever 71 articulated on a transverse horizontal pin 72 and carrying a roller 73 mounted rotatably on a pin perpendicular to the pin 72. The end 71a of the lever 71 bears against the lower end of the lever 24, whereas the roller 73 bears against a fixed stop 74 in the form of a cam having the shape of a symmetrical wave, the trough of which is situated on the axis of the ski. Under the pressure of the spring 18, the roller 73 tends to remain or to return to the base of this wave respectively.

Figure 4A:
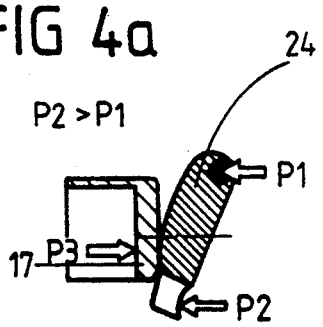
FIG. 4a is a view of the forces on lever 24 of FIG. 4.

Upon the exertion of a torsional stress, the roller 73 is pushed back by the cam 74, which causes the lever 71 to pivot in an anticlockwise direction, which causes the lever 24 to tilt, as in FIG. 4. The same conditions are thus to be found again as in the first embodiment with the same effects.

Figure 15:
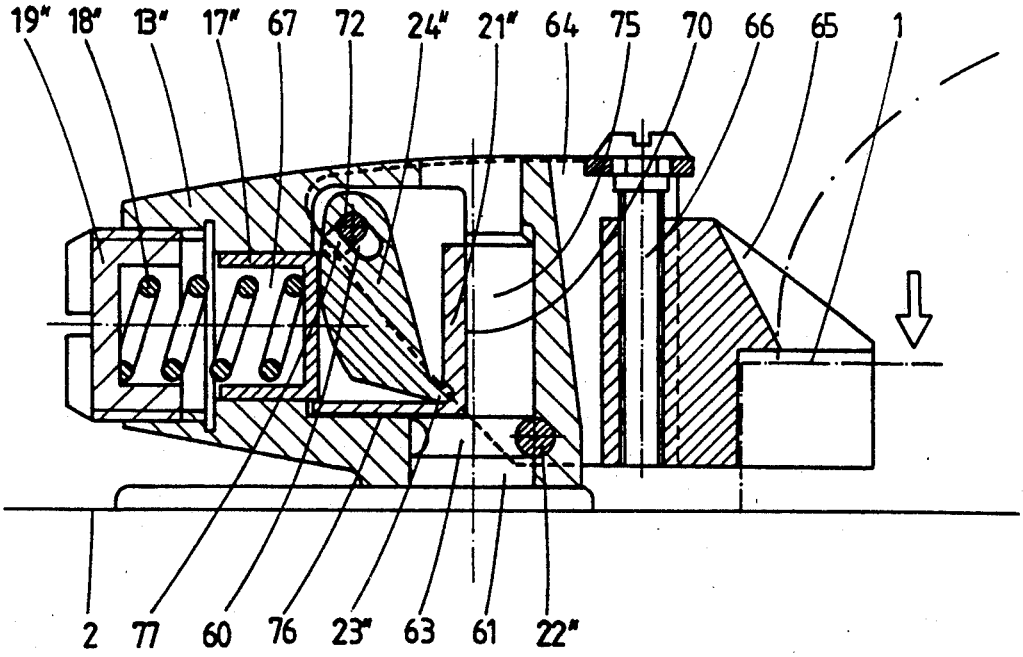
FIG. 15 is a view in vertical axial cross-section of a front toe unit according to a fifth embodiment.

A fifth embodiment is shown in FIG. 15. The binding shown, which may again be a front toe unit or a heel unit, comprises a body 13" mounted pivotably on a vertical pivot 61 on which it is retained by a pin 22" engaged in a recess 63 of the pivot 61. The pin 22" simultaneously forms the pivoting axis of a grip 64 on the body 60. This grip 64 is provided in a known manner with a part 65 which is height-adjustable by means of a screw 66 and bears against the boot 1.

The body 13" has a horizontal bore 67 in which is mounted a piston 17" on which acts a spring 18" bearing on the other hand against a threaded cap 19" enabling the precompression of the spring 18" to be adjusted. The piston 17" bears against a lever 24", the upper part of which is articulated on the grip 64 by means of a pin 72 parallel to the pin 22" and the lower end 23" of which is articulated, without any supplementary means, on a square-shaped sliding piece 21" , the vertical part of which bears against a vertical flat surface 70 formed on an extension of the pivot 61. This flat surface 70 is near the geometrical axis of the pivot 61. The horizontal part of the sliding piece 21" bears against a plane face 76 of the body 13" and against a horizontal plane face of the pivot 61. The part of the grip 64 pivoting on the body 13" consists of a piece of folded sheet metal having two flanges extending on either side of the body 13"'. The pin 72 therefore traverses the body 13" which has at this point two slots 77 in the arc of a circle which enable the grip to tilt. The lever 24" also has a slot 60 facing towards the pin 22".

When the body 13" is driven in rotation about its pivot 61, one of the vertical edges of the flat surface 70 pushes back the piece 21", causing the lever 24" to rotate in a clockwise direction about its end 23". As in the first embodiment, the contact point of the piston 17" against the lever 24" moves away from the pin 72, which causes the vertical pressure of the grip 64 on the boot to be reduced, this pressure nevertheless remaining sufficient to maintain the boot applied against the ski, unless the twisting is accompanied by a fall, forwards for a heel unit and backwards for a front toe unit respectively. In this case, the pin 72 is driven in rotation in an anticlockwise direction about the pin 22" and the lever 24" rotates in the same direction, pushing back the piston 17", the pin 72 nearing the piston 17" again, in a position similar or close to the position shown in the drawings.

A sixth embodiment of the binding according to the invention will now be described with reference to FIGS. 16, 17, 18 and 19. For the sake of simplification and in order to avoid repetitions, the parts of this binding which are similar to those in the first or third embodiment are designated by the same references, even if these parts have undergone some modifications in shape. The pieces corresponding to the levers 21 and 24 have been designated by 21" and 24"". Thus a body 13 is again to be found, mounted pivotably on the ski 2 by means of a pivot 14 and having a bore 46 in which two coaxial springs 47 and 53 are mounted, the precompression of which may be adjusted separately by means of two threaded caps 48 and 54, as in the third embodiment. In this case, the hinge pin 16 of the grip 15 traverses the bore 46. The first lever 21 is here replaced by a slide 21"" sliding in the bore 46 and bearing by the rounded rectilinear ridge 57 of a front nose against the incline 15a of the grip 15 under the pressure of the inner spring 53. A lever 24"" corresponding to the second lever 24 of the previous embodiments is articulated about a pin 23 at the rear of the slide 21"" in its upper part. This lever has at the front two transverse flanges 60 which are slightly curved and against which bears a piston 61 sliding in a bore 62 of the slide 21"" and on which acts the outer spring 47. This spring 47 therefore acts on the lever 24"", the curved flanges 60 of which are equivalent to the curved surface of the lever 24 of the previous embodiments. The lower end of the lever 24"" carries a vertical pin 65 on which is rotatably mounted a roller 66 bearing, under the influence of the spring 47, against the base of a fixed incline 67 similar to the incline 74 in FIG. 14. It should further be pointed out that the pin 16 of the grip 15 traverses the slide 21"" through a slot 68 so as to enable the displacement of the slide 21"", and that a clearance 69 is provided between the front end of the piston 61 and the base of the bore 62 of the slide 21"", against which base bears the inner spring 53.

In the event of a forward fall without twisting, the slide 21""" is pushed backwards by the grip 15 compressing the two springs 47 and 53, as shown in FIG. 18. The lever 24"" tilts slightly on the incline 67 such that the bearing point of the piston 61 on the curved flanges 60 is displaced upwards, as in the previous embodiments.

When a high torsional stress is exerted on the binding, the body 13 pivots and the roller 66 is displaced on the incline 67 to one or other side of the position shown in FIG. 17, which causes the lever 24"" and the piston 61, which compresses the spring 47 as shown in FIG. 19, to move. The bearing point of the piston 61 against the curved flanges 60 is displaced downwards, as in the previous embodiments. The slide 21'''' remains stationary and the spring 47 is no compressed. After the boot has been freed laterally, the incline 67 returns the body 13 to its initial position. If the binding is stressed both torsionally and by a forward or backward fall, depending on whether a heel unit or a front toe unit is involved, the displacements shown are added together, but not the energies.

In the case of the first and second embodiments, it is also possible to provide two springs acting on only one of the levers 21 and 24 respectively. Starting from FIG. 10, such an embodiment may be achieved by modifying the shape of the levers 21 and 24 and the shape of the pistons 45 and 52. Such a modification is shown in FIG. 20. The lever 24''', which is relatively narrow, is mounted in a groove 79 of the lever 21'''. The end of the outer piston 45 has two flanges 80 which bear respectively against the lever 21''' on either side of the groove 79. The width of the inner piston 52 is equal to the width of the lever 24'''.

Figure 21:
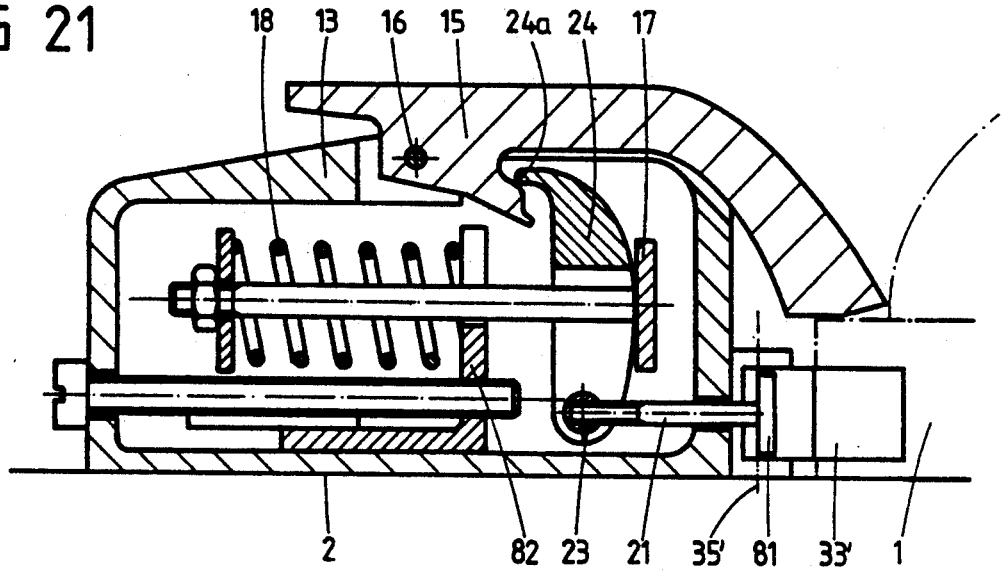
FIG. 21 diagrammatically shows a front toe unit with a stationary body.
Figure 22:
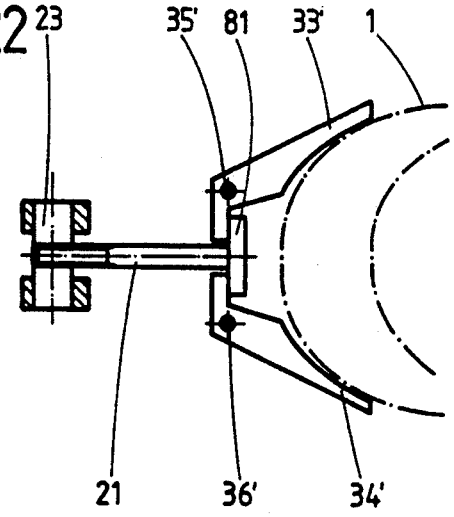
FIG. 22 is a plan view of the lateral-retention means for the toe unit shown in FIG. 21.

The principle according to the invention can also be applied to a binding with a fixed body. FIGS. 21 and 22 show very diagrammatically a first exemplary embodiment. So as to make the equivalence of the functions of the pieces of this front toe unit more evident, the same references as in FIGS. 1 and 2 have been used deliberately for the corresponding functional pieces.

Figure 21A:
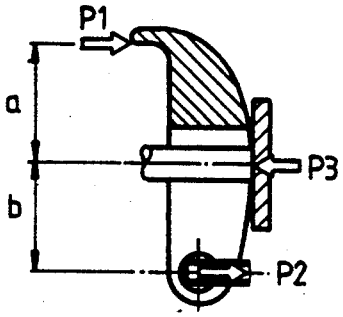
FIG. 21a shows the forces acting on the piece 24 in FIG. 21.

The binding comprises a fixed body 13 on which a grip 15 is articulated about a horizontal pin 16. The boot 1 is retained laterally by two levers 33' and 34' which pivot on fixed vertical pins 35' and 36'. One of the ends of the levers 33' and 34' bears against the head 81 of a drawbar 21 (first moving part), the other end of which is articulated by a pin 23 with the end of a lever 24 (second moving part), the other end of which has a nose **24*a* bearing against an incline of the grip 15. A piston 17, drawn by a spring 18 which bears against a part 82 integral with the body 13, bears against the curved face of the lever 24. The same system of forces is found as in FIG. 1*a* (shown in FIG. 21*a*) and the same considerations apply with regard to the variation of the lever arms and of the forces P1 and P2 and of the vertical pressure exerted by the grip 15** on the boot. When used as a front toe unit, this construction has the further advantage of automatically adapting the height of the grip to the boot.

Figure 23:
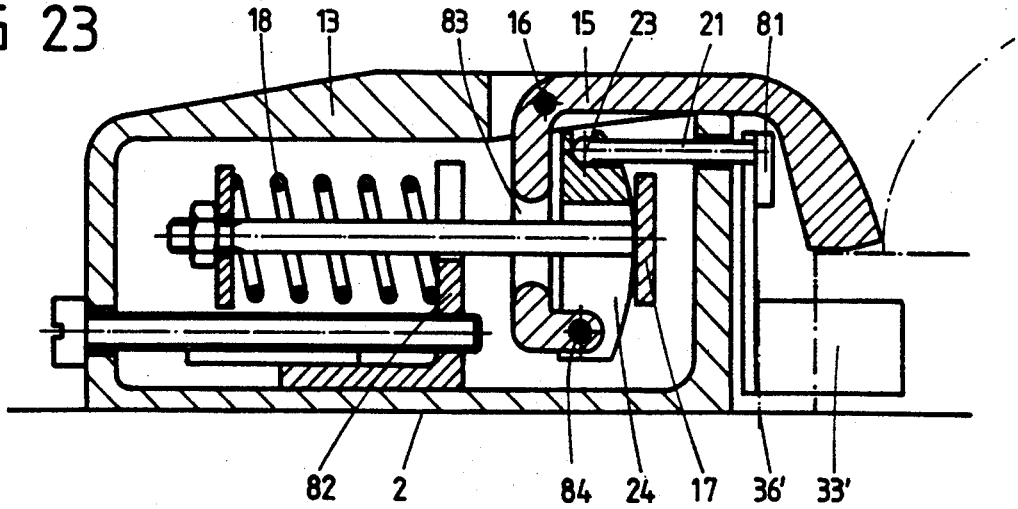
FIG. 23 diagrammatically shows another front toe unit with a stationary body.

The alternative embodiment shown diagrammatically in FIG. 23 differs from the previous embodiment only in the method of application of the force of the lever 24 to the grip. In this case, the lever 24 is articulated at the end of an arm 83 of the grip 15 about a pin 84.

In all the embodiments, the same effect could be obtained by giving the piston a cylindrical convex shape and the levers 24, 24', 24'' a plane bearing face.

I claim:

1. A ski safety binding able to release horizontally and vertically intended to hold in place the end of a boot, comprising:

a body;

a grip articulated on this body about a horizontal pin defining an articulation axis;

a lateral-retention means for retaining said boot;

elastic return means, for returning the lateral-retention means and the grip to a closed position of the binding, said return means comprising at least one spring acting via at least one piston on a transmission mechanism for performing a rotational and translational movement;

said spring being set between the piston and the grip and the lateral-retention means;

wherein said transmission mechanism comprises a first part including a rocking lever rocking in a plane perpendicular to said articulation axis, said rocking lever bearing permanently against the piston and bearing against the grip and the lateral-retention means in such a way that the position of said rocking lever is determined at each instant by first and second forces acting on opposed ends of the rocking lever, said first and second forces corresponding to different releasing directions, and by a third force acting between the first and second forces and in a direction opposed to said first and second forces via the piston; and wherein on of the rocking levers and the piston have a convex bearing surface positioned such that when the rocking lever is rocking, the bearing zone is moved in one of an upward and downward direction relatively to the piston thereby modifying gradually the lever arms of the forces acting on the rocker ends and wherein the body is mounted pivotally on a vertical pivot and the lateral-retention means comprise at least one fixed stop and wherein all the moving parts of the transmission mechanism are in permanent linear contact with the piston, the grip and the stop respectively and wherein the two moving parts consist of two levers, namely a first lever articulated about an axis parallel to the axis of articulation of the grip and provided with a nose bearing against an incline of the grip and a second moving part articulated in the upper part of the first moving part about an axis parallel to the axis of articulation of the grip, extending downwards and the end of which bears at least indirectly against the stop or stops respectively for returning the body under torsion and wherein the axis of the articulation of the first lever is secant to the axis of pivoting of the body and the lower end of the second lever bears against at least one lever, one arm of which bears against the fixed stop and wherein the rocking lever bears, via a transmission rod, against a first and second lever pivoted about two vertical axes symmetrically on each side of the longitudinal axis of the binding, and one arm of which bears respectively against two fixed stops arranged symmetrically on either side of the said longitudinal axis.

2. The binding as claimed in claim 1, wherein the end of the second lever bears against a lever which pivots about a horizontal axis parallel to the axis of articulation of the levers, this lever being provided with a roller bearing against a stop in the form of a cam.

3. The binding as claimed in claim 1, in which the stop consists of a vertical flat surface of the said vertical pivot, against which flat surface the said transmission mechanism bears directly, wherein one of the moving parts consists of a sliding piece bearing with a plane face against the stop and the other moving part consists of a lever articulated at one end on the said sliding part and the other end of which is articulated on the grip.

4. The binding as claimed in claim 1, wherein it comprises two coaxial springs, one of these springs interacting with a first piston bearing against the curved part of the second lever in the closed position of the binding, the second spring acting on a second piston capable of being pushed back by the first piston, the second lever also bearing against the second piston when the grip is raised.

5. The binding as claimed in claim 1, wherein the two moving parts consist of a slide bearing against the grip and on which a first spring acts and of a lever articulated, at one of its ends, on the said slide and on which acts a second spring via a piston, the other end of the lever being provided with a roller bearing against a fixed incline.

6. The binding as claimed in claim 1, wherein it comprises a first spring acting only on the first lever and a second spring acting only on the second.

7. The binding as claimed in claim 1, the said body is fixed and the lateral-retention means consist of two levers mounted on fixed vertical pins, one of the ends of these levers acting on a first moving part on which is articulated the end of a second moving part, consisting of a lever, the other end of which bears against the grip, the said piston bearing against the said lever.

8. The binding as claimed in claim 1, wherein the frontal face of the piston is plane and the moving part bearing against the piston has a cylindrical convex surface, with a generatrix parallel to the axis of articulation of the moving parts, in contact with the piston.

9. The binding as claimed in claim 1, wherein the piston has a cylindrical surface with a generatrix parallel to the axis of articulation of the moving parts and the face of the moving part bearing against the piston is plane.

* * * * *